US005409592A

United States Patent [19]

Meyer et al.

[11] Patent Number: 5,409,592

[45] Date of Patent: Apr. 25, 1995

[54] ELECTROLYTE ADDITIVE FOR A COLORANT BATH FOR COLORING ALUMINUM AND PROCESS FOR COLORING ALUMINUM

[75] Inventors: Loert D. Meyer, Duesseldorf; Volker Sander, Hilden; Juergen Lindener, Duesseldorf, all of Germany

[73] Assignee: Henkel Kommanditgesellschaft auf Aktien, Duesseldorf, Germany

[21] Appl. No.: 50,038

[22] PCT Filed: Oct. 21, 1991

[86] PCT No.: PCT/EP91/01994

§ 371 Date: Apr. 29, 1993

§ 102(e) Date: Apr. 29, 1993

[87] PCT Pub. No.: WO92/07976

PCT Pub. Date: May 14, 1992

[30] Foreign Application Priority Data

Oct. 29, 1990 [DE] Germany ..... 40 34 304.9

[51] Int. Cl.[6] ..... C25D 3/32; C25D 11/04

[52] U.S. Cl. ..... 205/105; 205/173; 205/253; 205/303; 205/324

[58] Field of Search ..... 205/105, 173, 174, 253, 205/303, 324

[56] References Cited

U.S. PATENT DOCUMENTS 4,042,468 8/1977 Hasegawa et al. ..... 204/42
5,064,512 11/1991 Brodalla et al. ..... 204/37.6

FOREIGN PATENT DOCUMENTS 354365 8/1989 European Pat. Off. .
752359 6/1969 France .
2384037 3/1977 France .
2428635 1/1975 Germany .
3426704 7/1983 Germany .
51-122637 of 1971 Japan .
48-101331 12/1973 Japan .
49-431674 3/1974 Japan .
51-147436 12/1976 Japan .
52-135841 11/1977 Japan .
53-18483 2/1978 Japan .
54-097545 8/1979 Japan .
57-200221 12/1982 Japan .
58-113391 7/1983 Japan .
1151460 7/1969 United Kingdom .
1408859 10/1975 United Kingdom .
1482390 8/1977 United Kingdom .
2609146 9/1976 WIPO .

OTHER PUBLICATIONS

S. A. Pozzoli, F. Tegiacchi; Korros, Korrosionsschutz Alum., (Stability of the Bivalent Tin Solutions Used for the Electrolytic Coloring of Anodized Aluminum), (no month) 1976, pp. 139–145.

*Primary Examiner*—John Niebling
*Assistant Examiner*—Edna Wong
*Attorney, Agent, or Firm*—Ernest G. Szoke; Wayne C. Jaeschke; Norvell E. Wisdom, Jr.

[57] ABSTRACT

The invention describes a novel electrolyte additive for a sulfuric acid tin(II) containing colorant bath for the alternating current coloring of anodized aluminum surfaces, consisting of a synergistic mixture of at least one antioxidant of one of the general formulas (I to IV) and at least one throwing power improver of general formula (V), and to a process for the alternating current coloration of anodized aluminum surfaces using the electrolyte additive of the invention.

14 Claims, No Drawings

ELECTROLYTE ADDITIVE FOR A COLORANT BATH FOR COLORING ALUMINUM AND PROCESS FOR COLORING ALUMINUM

FIELD OF THE INVENTION

This invention relates to a new electrolyte additive for a sulfuric acid coloring bath containing tin(II) for the alternating current coloring of anodized aluminum surfaces, which consists of a synergistic mixture of at least one antioxidant corresponding to one of general formulae I to IV and at least one throwing power improver corresponding to general formula V, and to a process for the alternating-current coloring of anodized aluminum surfaces using the electrolyte additive according to the invention.

STATEMENT OF RELATED ART

It is known that, on account of its base character, aluminum becomes covered with a natural oxide coating generally below 0.1 μm in thickness (Wernick, Pinner, Zurbrügg, Weiner, *Die Oberflächenbehandlung von Aluminum* (The Surface Treatment of Aluminum), 2nd Edition, (Eugen Leuze Verlag, Saulgau/Württ., 1977).

Considerably thicker oxide coatings can be obtained by electrolytic oxidation of aluminum. This process is known as anodizing. Sulfuric acid, chromic acid or phosphoric acid is preferably used as the electrolyte. Organic acids, such as for example oxalic acid, maleic acid, phthalic acid, salicylic acid, sulfosalicylic acid, sulfophthalic acid, tartaric acid or citric acid, are also used in some processes.

However, sulfuric acid is the most commonly used electrolyte. Depending on the anodizing conditions, layer thicknesses of up to 150 μm can be obtained in this process. However, layer thicknesses of 20 to 25 μm are sufficient for external applications, such as for example facade facings or window frames.

The anodizing process is generally carried out in 10 to 20% sulfuric acid with a current density of 1.5 $A/dm^2$, at a temperature of 18° to 22° C. and over a period of 15 to 60 minutes, depending on the required layer thickness and the particular application.

The oxide coatings thus produced have a high absorption capacity for a number of organic and inorganic substances or dyes.

Electrolytic coloring processes, in which anodized aluminum is colored by treatment with alternating current in heavy metal salt solutions, have been known since the middle of the thirties. The heavy metals used are, above all, elements of the first transition series, such as Cr, Mn, Fe, Co, Ni, Cu and, in particular, Sn. The heavy metal salts are generally sulfates, pH being adjusted to a value of 0.1 to 2.0 with sulfuric acid. The coloring process is carried out at a voltage of around 10 to 25 V and the resulting current density. The counter-electrode may either consist of graphite or stainless steel or of the same material which is dissolved in the electrolyte.

In this process, the heavy metal pigment is deposited in the pores of the anodic oxide coating in the half cycle of the alternating current in which aluminum is the cathode, the aluminum oxide coating being further thickened by anodic oxidation in the second half cycle. The heavy metal is deposited at the bottom of the pores and thus colors the oxide coating.

However, one of the problems encountered where coloring is carried out in tin electrolytes is that the tin readily oxidizes, so that basic tin(IV) oxide hydrates (stannic acid) are rapidly precipitated during the application and, in some cases, even during the storage of the Sn solutions. It is known that aqueous tin(II) sulfate solutions are oxidized to tin(IV) compounds simply by exposure to atmospheric oxygen or by reaction at the electrodes when current is applied. This is highly undesirable in the coloring of anodized aluminum in tin electrolytes because, on the one hand, it disrupts the process sequence (frequent renewal or topping up of the solutions rendered unusable by the formation of precipitates) and, on the other hand, leads to considerable extra costs because of the tin(IV) compounds which cannot be used for coloring. Accordingly, various processes have been developed, differing in particular in the means used to stabilize the generally sulfuric acid tin(II) sulfate solutions for the electrolytic coloring of aluminum.

Phenol-like compounds, such as phenol sulfonic acid, cresol sulfonic acid or sulfosalicylic acid, are by far the most commonly used (see, for example, in S. A. Pozzoli, F. Tegiacchi; *Korros. Korrosionsschutz Alum.*, Veranst. Eur. Foed. Korros. Vortr. 88th 1976, 139–45 or in published Japanese patent applications JP-A-78 13583, 78 18483, 77 135841, 76 147436, 74 31614, 73 101331, 71 20568, 75 26066, 76 122637, 54 097545, 56 081598 and in GB-C-1,482,390).

Polyhydric phenols such as, for example, the diphenols hydroquinone, pyrocatechol and resorcinol (see published Japanese applications JP-A-58 113391, 57 200221 and in FR-C-23 84 037) and the triphenols phloroglycinol (JP-A-58 113391 ), pyrogallol (S. A. Pozzoli, F. Tegiacchi; *Korros. Korrosionsschutz Alum.*, Veranst. Eur. Foed. Korros., Vortr. 88th 1976, 139–45 or in published Japanese patent applications JP-A-58 113391 and 57 200221) and gallic acid (JP-A-53 13583) have also been described in this connection.

Another significant problem in electrolytic coloring is so-called throwing power (depth throwing) which is understood to be the ability of a product to color anodized aluminum parts situated at different distances from the counter-electrode with a uniform color. Good throwing power is particularly important when the aluminum parts used are complicated in shape (coloring of depressions), when the aluminum parts are very large and when, for economic reasons, several aluminum parts have to be simultaneously colored in a single coloring process and medium color tones are to be obtained. In practice, therefore, high throwing power is highly desirable because faulty production is avoided and the optical quality of the colored aluminum parts is generally better. The process is made more economical by good throwing power because several parts can be colored in a single operation.

Throwing power is not the same as uniformity and a clear distinction has to be drawn between the two. Uniformity is coloring with the fewest possible local variations in color tone (patchy coloring). Poor uniformity is generally caused by impurities, such as nitrate, or by errors in the anodizing process. A good coloring electrolyte should never adversely affect the uniformity of coloring.

Although a coloring process may achieve high uniformity, it may still have poor throwing power; the reverse is also possible. In general, uniformity is only influenced by the chemical composition of the electrolyte while throwing power is also dependent upon electrical and geometric parameters, such as for example the shape of the workpiece or its positioning and size.

DE-A-26 09 146 describes a process for coloring in tin electrolytes, in which throwing power is established through the particular circuit and voltage arrangement.

DE-A-24 28 635 describes the use of a combination of tin(II) salts and zinc salts with addition of sulfuric acid and boric acid and also aromatic carboxylic and sulfonic acids (sulfophthalic acid or sulfosalicylic acid) in the electrolytic coloring of anodically oxidized aluminum articles in grey tones. Excellent throwing of the coloring effect is said to be obtained in particular when the pH value is between 1 and 1.5. pH adjustment to 1–1.5 is a basic prerequisite for good electrolytic coloring. There is no mention of whether the organic acids added have an effect on throwing power, nor is the throwing power achieved quantitatively described.

DE-C-32 46 704 describes a process for electrolytic coloring in which good throwing power is guaranteed by the use of special geometry in the coloring bath. In addition, cresol and phenol sulfonic acid, organic substances, such as dextrin and/or thiourea and/or gelatine, are said to guarantee uniform coloring. The disadvantage of this process lies in the high capital outlay involved in installation of the necessary equipment. The addition of deposition inhibitors, such as dextrin, thiourea and gelatin, has only a slight influence on throwing power because the deposition process in electrolytic coloring differs significantly from that in electro-tin-plating. There is also no reference in the document in question to possible methods of measuring the improvements in throwing power.

In addition, European patent application EP-A-354 365 describes a process for the electrolytic coloring of anodized aluminum surfaces using metal salts, in which the antioxidants corresponding to general formulae I and IV (cf. the claims) are used together with the throwing power improvers p-toluene sulfonic acid and/or naphthalene sulfonic acid. However, the throwing power improvers mentioned in this document lead during electrolysis to foul-smelling decomposition products so that these throwing power improvers are no longer being used.

DESCRIPTION OF THE INVENTION

Object of the Invention

Now, the problem addressed by the present invention was to provide a new electrolyte additive for a sulfuric acid coloring bath containing tin(II) for the alternating-current coloring of anodized aluminum surfaces which would overcome the problems known from the prior art discussed in the foregoing, such as guaranteeing lasting stability of the coloring bath, avoiding the oxidation of Sn(II) and, at the same time, guaranteeing good throwing power.

SUMMARY OF THE INVENTION

Accordingly, the present invention relates to an electrolyte additive for a sulfuric acid coloring bath containing tin(II) for the alternating-current coloring of anodized aluminum surfaces containing at least one antioxidant and at least one throwing power improver, characterized in that the electrolyte additive contains a) as antioxidant at least one compound corresponding to general formulae I to IV:

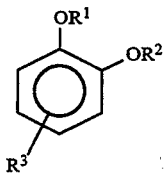

(I)

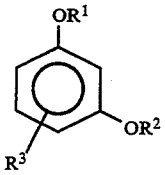

(II)

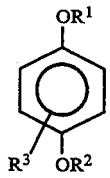

(III)

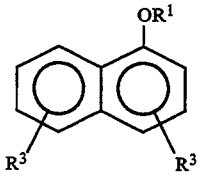

(IV)

in which $R^1$ and $R^2$ represent hydrogen, alkyl, aryl, alkylaryl, alkylaryl sulfonic acid, alkyl sulfonic acid containing 1 to 22 carbon atoms and alkali metal salts thereof and $R^3$ represents one or more hydrogen and/or alkyl, aryl, alkylaryl moieties containing 1 to 22 carbon atoms, at least one of the substituents $R^1$, $R^2$ and $R^3$ not being hydrogen, and b) as throwing power improver at least one aromatic carboxylic acid corresponding to general formula V:

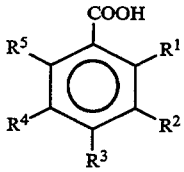

(V)

in which $R^1$ to $R^5$ represent hydrogen, hydroxyl, carboxyl and/or sulfonic acid groups.

The present invention also relates to a process for the alternating-current coloring of anodized aluminum surfaces in a sulfuric acid coloring bath containing tin(II), characterized in that an electrolyte additive as defined above is used for electrolytic coloring in the sulfuric acid coloring bath containing tin(II) at a pH value of 0.1 to 2.0, at a temperature of 10° to 30 ° C. and with an alternating current voltage with a frequency of 50 to 60 hertz and a terminal voltage of 10 to 25 V.

A major advantage of the electrolyte additive according to the invention lies in the use of oxidation-stable, water-soluble throwing power improvers. It is particularly after relatively long periods of operation that the p-toluene sulfonic acid known from the teaching of EP-A-354 365 emits foul-smelling vapors through oxidation of the methyl group so that the coloring bath cannot be used for prolonged periods. According to the invention, therefore, it is particularly important to provide the throwing power improver with oxidation-stable functional groups, such as carboxyl, hydroxyl and/or sulfonic acid groups. In addition, the functional groups mentioned guarantee the necessary solubility in water.

DESCRIPTION OF PREFERRED EMBODIMENTS

In one preferred embodiment of the invention, the electrolyte additive contains at least one of the compounds corresponding to one of general formulae I to IV in a quantity of 0.01 to 2 g/l as antioxidant and at least one of the compounds corresponding to general formula V in a quantity of 0.1 to 30 g/l, based on the coloring bath, as throwing power improver.

According to the invention, 2-tert-butyl-1,4-dihydroxybenzene (tert-butyl hydroquinone),methylhydroquinone, trimethyl hydroquinone, 4-hydroxy-2,7-naphthalene disulfonic acid and/or p-hydroxyanisole in particular are used in the concentrations mentioned above as the antioxidants corresponding to general formulae I to IV.

According to the invention, 5-sulfosalicylic acid, 4-sulfophthalic acid, 2-sulfobenzoic acid, benzoic acid and/or benzene hexacarboxylic acid are used as throwing power improvers corresponding to general formula V. The use of 5-sulfosalicylic and 4-sulfophthalic acid together has proved to be particularly effective by virtue of the synergistic effect produced.

In one preferred embodiment of the invention, therefore, the electrolyte additive according to the invention contains (based on the total volume of the coloring bath):

a) t-butyl hydroquinone in a quantity of 0.01 to 2 g/l as antioxidant and b) 5-sulfosalicylic acid in a quantity of 0.5 to 6 g/l and 4-sulfophthalic acid in a quantity of 5 to 20 g/l as throwing power improvers.

In one particularly preferred embodiment, the electrolyte additive according to the invention contains in particular (based on the total volume of the coloring bath):

a) t-butyl hydroquinone in a quantity of 0.1 to 0.5 g/l and preferably in a quantity of 0.2 to 0.3 g/l as antioxidant and b) 5-sulfosalicylic acid in a quantity of 1 to 3 g/l and preferably 1.5 to 2.5 g/l and 4-sulfophthalic acid in a quantity of 8 to 12 g/l and preferably 10 g/l as throwing power improvers.

The coloring process is normally carried out using a tin(II) sulfate solution containing approximately 3 to 20 g and preferably 7 to 16 g tin(II) per liter. In a preferred embodiment, the coloring process is carried out at a pH value of 0.1 to 2.0, corresponding to 16 to 22 g sulfuric acid per liter, and at a temperature of approximately 14° to 30° C. The alternating current voltage or the alternating current voltage superimposed on direct current (50 to 60 hertz) is preferably adjusted to a value of 10 to 25 V and, more preferably, to a value of 15 to 18 V with an optimum at approximately 17 V±3 V.

In the context of the invention, alternating current coloring is understood to be either coloring with pure alternating current or coloring with "alternating current superimposed on direct current" or "direct current superimposed on alternating current". The figure shown is always the terminal voltage. Coloring begins at a resulting current density of generally about 1 $A/dm^2$ which then falls to a constant value of 0.2 to 0.5 $A/dm^2$. The color tones obtained, which can vary from champagne through various bronze tones to black, differ according to the voltage, the metal concentration in the coloring bath and the immersion times.

In another embodiment, the process according to the invention is characterized in that the electrolyte contains other heavy metal salts besides tin, for example nickel, cobalt, copper and/or zinc (see Wernick, et al., loc. cit.).

The electrolyte additive according to the invention is illustrated by the following Examples:

EXAMPLES

Test Methods a) Accelerated Test for Evaluating the Stability of the Baths in Storage (Test 1 )

An aqueous electrolyte was prepared, containing 20 g/l of sulfuric acid and 10 g/l of Sn(II) ions and corresponding quantities of an electrolyte additive. 1 liter solutions were vigorously stirred with a magnetic stirrer at room temperature and aerated through a glass frit with 12 l/h of pure oxygen. The content of Sn(II) ions was iodometrically determined after 4 hours. The percentage reduction in the concentration of Sn(II) was recorded.

b) Evaluation of the Antioxidant Effect Under Current (Test 2)

An aqueous electrolyte was prepared, containing 20 g/l of sulfuric acid, 10 g/l of Sn(II) ions and corresponding quantities of an electrolyte additive. The continuous electrolysis (alternating current 50 hertz, voltage 12 V) was carried out with stainless steel electrodes. The quantity of current flowing was recorded with an ampere-hour counter. The characteristic behavior of the oxide coating to be colored was simulated by corresponding sine distortion of the alternating current under a high capacitive load. The quantity of Sn(II) ions oxidized by electrode reactions was determined by continuous iodometric titration of the electrolyte and by gravimetric determination of the reductively deposited Sn and the difference between the sum of these two values and the starting quantity of dissolved Sn(II). The ampere-hour value at which a reduction in the Sn(II) concentration of 5 g/l can no longer be prevented was selected as a measure of the antioxidant effect.

c) Evaluation of Throwing Power (Test 3)

50 mm×460 mm×1 mm sample plates of the DIN material Al 99.5 were conventionally pretreated and then electrolytically colored in a coloring bath of suitable geometry (electrode at a distance at 1 to 5 cm from the counter electrodes). In addition to 10 g/l of Sn(II) and 20 g/l of sulfuric acid, the coloring bath also contained various quantities of the test substances (see Examples and Comparison Examples). Coloring was routinely carried out for 5 minutes at 16 V (alternating current 50 hertz). The coloring result was numerically determined as follows: first the distribution of tin over the test plate was determined at ten different places in the longitudinal direction (i.e. at 5 cm intervals) by measurement with a scattered light reflectometer against the white standard titanium dioxide (=99% ). The "average coloring" is obtained from the individual measurements. Throwing power is determined therefrom as a measure of the accordance of each measuring point with the average value and is expressed as a percentage. A throwing power of 100% means that the test plate is evenly colored over its entire length. The closer the values come to the value 0%, the more differently the ends of the plate are colored.

Electrolytic Coloring

Test plates of the DIN material Al 99.5 (No. 3.0255) were conventionally pretreated (degreased, pickled, descaled) and anodized for 60 minutes by the GS process (200 g/l of sulfuric acid, 10 g/l of Al(III), air throughput, 1.5 A/dm$^2$, 18° C.). A layer thickness of about 20 μm was obtained. The plates thus pretreated were electrolytically colored with alternating current (50 hertz) as described in the following Examples. The results are set out in Table 1.

TABLE 1

| | Test 1 [stability in storage in %] | Test 2 [Antioxidant effect in Amp-hours] | Test 3 [Throwing power %] |
|---|---|---|---|
| Example 1 | 0 | 810 | 99 |
| Example 2 | 0 | 810 | 83 |
| Example 3 | 0 | 809 | 90 |
| Example 4 | 0 | 800 | 99 |
| Example 5 | 0 | 880 | 99 |
| Example 6 | 0 | 810 | 99 |
| Example 7 | 0 | 875 | 97 |
| Comparison Example 1 | 72 | 560 | 54 |
| Comparison Example 2 | 0 | 810 | 55 |
| Comparison Example 3 | 69 | 570 | 86 |
| Comparison Example 4 | 70 | 565 | 90 |
| Comparison Example 5 | 0 | 800 | 96 |

| | |
|---|---|
| Example 1 | |
| Electrolyte: | 10.0 g/l of Sn(II)<br>10.0 g/l of sulfuric acid<br>0.2 g/l of t-butyl hydroquinone<br>2.0 g/l of 5-sulfosalicylic acid<br>10.0 g/l of 4-sulfophthalic acid |
| Coloring parameters: | 16 V, 5 minutes |
| Example 2 | |
| | 10.0 g/l of Sn(II)<br>20.0 g/l of sulfuric acid<br>0.2 g/l of t-butyl hydroquinone<br>2.0 g/l of 5-sulfosalicylic acid |
| Coloring parameters: | 16 V, 5 minutes |
| Example 3 | |
| | 10.0 g/l of Sn(II)<br>20.0 g/l of sulfuric acid<br>0.2 g/l of t-butyl hydroquinone<br>10.0 g/l of 4-sulfophthalic acid |
| Coloring parameters: | 16 V, 5 minutes |
| Example 4 | |
| | 10.0 g/l of Sn(II)<br>20.0 g/l of sulfuric acid<br>0.2 g/l of methyl hydroquinone<br>2.0 g/l of 5-sulfosalicylic acid<br>10.0 g/l of 4-sulfophthalic acid |
| Coloring parameters: | 16 V, 5 minutes |
| Example 5 | |
| | 10.0 g/l of Sn(II)<br>20.0 g/l of sulfuric acid<br>0.2 g/l of trimethyl hydroquinone<br>2.0 g/l of 5-sulfosalicylic acid<br>10.0 g/l of 4-sulfophthalic acid |
| Coloring parameters: | 16 V, 5 minutes |
| Example 6 | |
| | 10.0 g/l of Sn(II)<br>20.0 g/l of sulfuric acid<br>0.2 911 of t-butyl hydroquinone<br>10.0 g/l of benzene hexacarboxylic acid |
| Coloring parameters: | 16 V, 5 minutes |
| Example 7 | |
| | 10.0 g/l of Sn(II)<br>20.0 g/l of sulfuric acid<br>0.2 g/l of trimethyl hydroquinone<br>20.0 g/l of sulfobenzoic acid |
| Coloring parameters: | 16 V, 5 minutes |
| Comparison Example 1 | |
| Electrolyte: | 10.0 g/l of Sn(II)<br>20.0 g/l of sulfuric acid |
| Coloring parameters: | 16 V, 5 minutes |
| Comparison Example 2 | |
| Electrolyte: | 10.0 g/l of Sn(II)<br>20.0 g/l of sulfuric acid<br>0.2 g/l of t-butyl hydroquinone |
| Coloring parameters: | 16 V, 5 minutes |
| Comparison Example 3 | |
| Electrolyte: | 10.0 g/l of Sn(II)<br>20.0 g/l of sulfuric acid<br>2.0 g/l of 5-sulfosalicylic acid |
| Coloring parameters: | 16 V, 5 minutes |
| Comparison Example 4 | |
| Electrolyte: | 10.0 g/l of Sn(II)<br>20.0 g/l of sulfuric acid<br>10.0 g/l of 4-sulfophthalic acid |
| Coloring parameters: | 16 V, 5 minutes |
| Comparison Example 5 | |
| Electrolyte: | 10.0 g/l of Sn(II)<br>20.0 g/l of sulfuric acid<br>0.2 g/l of t-butyl hydroquinone<br>20.0 g/l of p-toluene sulfonic acid |
| Coloring parameters: | 16 V, 5 minutes |

The results in Table 1 clearly show that an electrolyte additive containing a mixture of an antioxidant corresponding to one of general formulae I to IV and a throwing power improver corresponding to general formula V (Examples 1 to 7) clearly improves the coloring properties of the tin(II) salt electrolyte, such as stability in storage, antioxidant effect and throwing power, in relation to Comparison Examples 1 to 4. In the case of Comparison Example 5, an intensifying foul-smelling odor occurs after only 15 minutes.

The invention claimed is:

1. An electrolyte additive for a sulfuric acid coloring bath containing tin(II) for the alternating-current coloring of anodized aluminum surfaces, said electrolyte additive comprising:

a) as antioxidant at least one compound selected from the group consisting of 2,7-disulfo-4-hydroxynaphthalene and compounds corresponding to one of the general formulae I to IV:

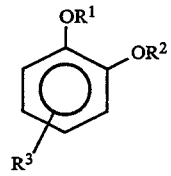

(I)

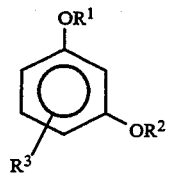

(II)

-continued (III)

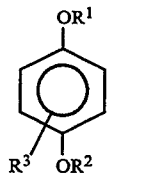

(IV)

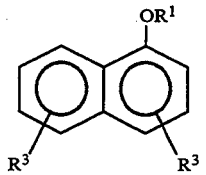

in which $R^1$ and $R^2$ represent hydrogen, alkyl, aryl, alkylaryl, alkylaryl sulfonic acid, alkyl sulfonic acid containing 1 to 22 carbon atoms and alkali metal salts thereof and $R^3$ represents one or more hydrogen or alkyl, aryl, alkylaryl moieties containing 1 to 22 carbon atoms, at least one of the substituents $R^1$, $R^2$ and $R^3$ not being hydrogen; and b) as throwing power improver at least one of (i) a combination or sulfosalicylic acid and 4-sulfophthalic acid, (ii) 2-sulfobenzoic acid, and (iii) benzene hexacarboxylic acid.

2. A sulfuric acid coloring bath for the alternating-current coloring of anodized aluminum surfaces, said coloring bath comprising an additive as claimed in claim 1 in a quantity such that the concentration of component (a) is from 0.01 to 2 g/l and the concentration of component (b) is from 0.1 to 30 g/l, based on the total volume of the coloring bath.

3. An additive as claimed in claim 1, wherein said antioxidant comprises at least one component selected from the group consisting of t-butyl hydroquinone, methyl hydroquinone, trimethyl hydroquinone, p-hydroxyanisole and 2,7-disulfo-4-hydroxynaphthalene.

4. A coloring bath as claimed in claim 2, comprising:

a) t-butyl hydroquinone in a quantity of 0.01 to 2 g/l as antioxidant and b) 5-sulfosalicylic acid in a quantity of 0.5 to 6 g/l and 4-sulfophthalic acid in a quantity of 5 to 20 g/l, based on the total volume of the coloring bath, as throwing power improvers.

5. A coloring bath as claimed in claim 4, comprising:

a) t-butyl hydroquinone in a quantity of 0.2 to 0.3 g/l as antioxidant and b) 5-sulfosalicylic acid in a quantity of 1.5 to 2.5 g/l and 4-sulfophthalic acid in a quantity of 10 g/l, based on the total volume of the coloring bath, as throwing power improvers.

6. A process for the alternating-current coloring of anodized aluminum surfaces in a sulfuric acid coloring bath containing tin(II) and an electrolyte additive as claimed in claim 1 and having a pH value of 0.1 to 2.0, said coloring being performed at a temperature of 10° to 30° C. with an alternating current with a frequency of 50 to 60 hertz and a terminal voltage of 10 to 25 V.

7. A coloring bath as claimed in claim 2, comprising at least one component selected from the group consisting of t-butyl hydroquinone, methyl hydroquinone, trimethyl hydroquinone, p-hydroxyanisole and 2,7-disulfo-4-hydroxynaphthalene.

8. A coloring bath as claimed in claim 4, comprising:

a) t-butyl hydroquinone in a quantity of 0.1 to 0.5 g/l as antioxidant and b) 5-sulfosalicylic acid in a quantity of 1 to 3 g/l and 4-sulfophthalic acid in a quantity of 8 to 12 g/l, based on the total volume of the coloring bath, as throwing power improvers.

9. A process for the alternating-current coloring of anodized aluminum surfaces in a sulfuric acid coloring bath as claimed in claim 8 having a pH value of 0.1 to 2.0, said coloring being performed at a temperature of 10° to 30° C. with an alternating current with a frequency of 50 to 60 hertz and a terminal voltage of 10 to 25 V.

10. A process for the alternating-current coloring of anodized aluminum surfaces in a sulfuric acid coloring bath as claimed in claim 7 having a pH value of 0.1 to 2.0, said coloring being performed at a temperature of 10° to 30° C. with an alternating current with a frequency of 50 to 60 hertz and a terminal voltage of 10 to 25 V.

11. A process for the alternating-current coloring of anodized aluminum surfaces in a sulfuric acid coloring bath as claimed in claim 5 having a pH value of 0.1 to 2.0, said coloring being performed at a temperature of 10° to 30° C. with an alternating current with a frequency of 50 to 60 hertz and a terminal voltage of 10 to 25 V.

12. A process for the alternating-current coloring of anodized aluminum surfaces in a sulfuric acid coloring bath as claimed in claim 4 having a pH value of 0.1 to 2.0, said coloring being performed at a temperature of 10° to 30° C. with an alternating current with a frequency of 50 to 60 hertz and a terminal voltage of 10 to 25 V.

13. A process for the alternating-current coloring of anodized aluminum surfaces in a sulfuric acid coloring bath containing tin(II) and an electrolyte additive as claimed in claim 3 and having a pH value of 0.1 to 2.0, said coloring being performed at a temperature of 10° to 30° C. with an alternating current with a frequency of 50 to 60 hertz and a terminal voltage of 10 to 25 V.

14. A process for the alternating-current coloring of anodized aluminum surfaces in a sulfuric acid coloring bath as claimed in claim 2 having a pH value of 0.1 to 2.0, said coloring being performed at a temperature of 10° to 30° C. with an alternating current with a frequency of 50 to 60 hertz and a terminal voltage of 10 to 25 V.

* * * * *